US008820877B2

(12) United States Patent
Yanagishita

(10) Patent No.: US 8,820,877 B2
(45) Date of Patent: Sep. 2, 2014

(54) PRINTING APPARATUS

(71) Applicant: Seiko Epson Corporation, Tokyo (JP)

(72) Inventor: Kenji Yanagishita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 13/658,613

(22) Filed: Oct. 23, 2012

(65) Prior Publication Data

US 2013/0106938 A1 May 2, 2013

(30) Foreign Application Priority Data

Oct. 26, 2011 (JP) ..... 2011-234714

(51) Int. Cl.

| | |
|---|---|
| ***B41J 29/38*** | (2006.01) |
| ***B41J 29/393*** | (2006.01) |
| ***B41J 2/01*** | (2006.01) |
| ***B41J 11/06*** | (2006.01) |
| ***B41J 3/407*** | (2006.01) |

(52) U.S. Cl.

CPC ..... *B41J 3/4078* (2013.01); *B41J 11/06* (2013.01)

USPC ..... 347/16; 347/5; 347/19; 347/104

(58) Field of Classification Search

USPC ..... 347/2–5, 16, 19, 101, 104

See application file for complete search history.

(56) References Cited

U.S. PATENT DOCUMENTS

| | | | | |
|---|---|---|---|---|
| 7,237,890 | B2 * | 7/2007 | Niimi et al. | 347/104 |
| 7,614,810 | B2 * | 11/2009 | Naito | 400/615.2 |
| 7,874,629 | B2 | 1/2011 | Mizutani | |
| 2009/0056582 | A1 | 3/2009 | Mizutani | |

FOREIGN PATENT DOCUMENTS

| | | |
|---|---|---|
| JP | 2009-051114 | 3/2009 |

OTHER PUBLICATIONS

European Search Report dated Feb. 22, 2013 for European Patent Application No. 12189556.9.

* cited by examiner

*Primary Examiner* — Anh T. N. Vo
(74) *Attorney, Agent, or Firm* — Workman Nydegger

(57) ABSTRACT

A printing apparatus includes a replaceable set tray on which a target printing material is set, an ink discharge unit which prints by discharging ink according to printing data onto the target printing material, a storage unit which stores the type of set tray specified in the printing data when printing is performed, a detection unit which detects the type of set tray, and a control unit which controls the tray detection operation. The tray detection operation is performed by the detection unit before printing starts and detects the type of set tray when necessary. The control unit compares the type of set tray specified in newly acquired printing data and the type of set tray stored in the storage unit. When the types are different, the tray detection operation is performed. When the types are the same, the tray detection operation is omitted.

12 Claims, 13 Drawing Sheets

3A, 3
3B, 3
3C, 3
23
25, 28
27, 28

3A, 3
3B, 3
3C, 3
3D, 3
23
25, 28
27, 28
2, 28

PRINTING APPARATUS

BACKGROUND

1. Technical Field

Embodiments of the present invention relate to a printing apparatus to perform printing on a target printing material. Embodiments of the invention further relate to printing on a fabric that is set in a set tray attached to the printing apparatus.

2. Related Art

An ink jet printing apparatus has been developed that prints a desired color pattern, such as an image, by discharging each color of ink from an ink discharge head to a surface of a fabric such as a T-shirt. When printing, the fabric can be set in a set tray which can be attached to the ink jet printing apparatus.

The ink jet printing apparatus can be used with different set trays that have different shapes and sizes. The set tray used for a given printing can depend on the size or shape of the fabric, a difference in the size of the image which is printed, the direction of printing, how many sheets of fabric are printed at the same time, or differences in the mode of printing such as when printing on a single sheet of fabric. The set tray can be replaced by a normal user.

In the ink jet printing apparatus, printing data is sent from a personal computer, which is an example of external equipment, ink is ejected from ink discharge unit to the target printing material on the basis of the printing data and the desired image is printed on the target medium. The type of set tray used in the printing is also included in the printing data. In a case where the type of set tray used in a current new printing is switched to a type of set tray that is different from the set tray used in the previous printing, a replacement task is performed to replace the set tray actually attached to the printing apparatus. In addition, update operations are performed on the printing data. Then, the type of set tray specified in the printing data is stored in the storage unit of the printing apparatus during execution of the printing process.

If there is a mismatch between the type of set tray specified in the printing data and the type of set tray actually attached to the ink jet printing apparatus, the printing process will not be effectively or efficiently performed and will not be performed as intended. For example, an unnecessary amount of the target printing material or fabric may be consumed when there is a mismatch between the type of set tray specified in the printing data and the type of set tray actually attached to the ink jet printing apparatus.

JP-A-2009-51114 is an example of a reference that discusses and considers the problem based on the above "mismatch". The technology disclosed in JP-A-2009-51114 compares the information that is stored in the storage unit regarding the type of set tray used during the previous printing and the information on the type of set tray specified for a current new printing. If the type of set tray is different from the previous time to the current time, an alarm is sounded to inform the user.

In JP-A-2009-51114, the determination of whether there is a difference in the type of set tray is based only on input information which relates to the type of set tray used in the current new printing and stored information which relates to the type of set tray used in the previous printing.

However, when a user sets printing data for a new printing using the external equipment (personal computer, or the like), in a case where the type of set tray changes to a different type, an input operation is performed to newly reconfigure the type of set tray. Then, in a case where the input operation is performed, it becomes necessary to perform a replacement task for replacing the set tray which is attached to the printing apparatus.

However, in a case where the user performing the replacement work makes a mistake and replaces the set tray with the wrong type of set tray, the technology referenced in JP-A-2009-51114 is completely unable to respond and unable to notify the user of the error. Furthermore, the ability to improve the printing throughput has not been taken into consideration at all in JP-A-2009-51114.

SUMMARY

An advantage of some aspects of embodiments of the invention is to reduce the concern of printing in a situation where the wrong type of set tray is attached to a printer, and to further improve the printing throughput when set trays are used in printing.

In one embodiment, a printing apparatus is provided. The printing apparatus includes a replaceable set tray on which a target printing material is set or placed, an ink discharge unit which prints by discharging ink onto the target printing material according to printing data, a storage unit which stores the type of set tray specified in the printing data when printing is performed, a detection unit which detects the type of set tray attached to the printing apparatus, and a control unit which controls a tray detection operation for detecting the type of set tray.

The operation of detecting the type of set tray may be performed by the detection unit before printing starts. In the detection operation, the control unit compares the type of set tray specified in newly acquired printing data with the type of set tray stored in the storage unit. When the set tray types are different, the tray detection operation is performed. When the set tray types are the same, the tray detection operation is omitted.

In a case where the type of set tray specified in newly acquired printing data and the type of set tray stored in the storage unit are different, a replacement task may be performed in order to change the set tray attached to the printing apparatus to a corresponding, different type of set tray. In a case where, in performing the replacement task, the user makes a mistake and replaces the set tray with the wrong type of set tray, and printing is performed in that state, the printing is not performed as intended, and a problem of unnecessary consumption of the target printing material occurs.

The control unit compares the type of set tray specified in the newly acquired printing data and the type of set tray stored in the storage unit. In a case where both types are different, the control unit performs the tray detection operation. Accordingly, it is possible to ascertain the type of set tray that is actually attached to the printing apparatus by executing the tray detection operation. In so doing, it is possible to determine whether the correct type of set tray is attached. By executing printing as is in a case where the type of set tray is the correct type, and not executing printing in a case where the type of set tray is the wrong type, it is possible to reduce the concern of executing printing or of performing a printing process in a state where the wrong type of set tray is attached to the printing apparatus and it is possible to avoid other problems such as the unnecessary consumption of target printing material.

Further, in a case where the result of comparing the newly specified type of set tray and the type of set tray stored in the storage unit is that both types are the same, the set tray replacement task is not performed, and it can be said that there is no concern that the wrong set tray is attached. Since in this case the tray detection operation is omitted, it is possible to improve printing throughput by eliminating unnecessary tray detection operations.

Here, "target printing material" signifies, by way of example and not limitation, a "textile" that is the target of printing. Target printing material includes, but is not limited to, natural fibers such as cotton, silk, wool, and synthetic fibers such as nylon, woven cloths with composite fibers with a mixture of these, including non-woven fabric such as knitting, and includes both roll-like wound, long fabrics and fabrics cut to a predetermined length. Furthermore, in addition to clothing that has already been sewn, such as T-shirts, and furnishings after sewing, such as handkerchiefs, scarves, towels, curtains, bed sheets, and bed covers, textiles before and after cutting which exist as parts in a state before being sewn are also included. In other words, printing jobs can be performed on target printing materials before and/or after the target printing materials are sewn.

In one embodiment, the control unit performs the tray detection operation in a case where the newly acquired printing data is content including settings related to the type of set tray. The control unit omits the tray detection operation in a case where the data is content not including the settings. The printing data may thus include or not include settings related to the type of set tray.

In one example, "printing data is content that includes settings related to the type of set tray" is, basically, settings which change the type of set tray specified in the printing data to a different type.

However, even if the type of set tray is not finally changed, the possibility of the set tray replacement work being done incorrectly is high. In a case where a part of the setting operation which relates to the change including such a case is performed, when the setting operation is made to include the "printing data is content that includes settings related to the type of set tray", it is possible to increase reliability by reducing the concern of executing printing in a state where the wrong type of set tray is attached, for example, in a case where a change operation is executed but is returned to the original for any reason once the intention changes, which is useful.

In one example, the control unit performs the tray detection operation in a case where newly acquired printing data is content including the settings related to the type of set tray, and omits the tray detection operation in a case where the data is content not including the settings. Accordingly, it is possible to reduce the concern of executing printing or performing the printing process in a state where the wrong type of set tray is attached by executing the tray detection operation.

Furthermore, as a result of the comparison, if the newly acquired printing data is content not including the settings related to the type of set tray, since there is no need for the set tray replacement task, the state where the wrong type of set tray is attached to the printing apparatus does not occur. In one example, since in this case the tray detection operation is omitted, it is possible to improve the printing throughput by eliminating unnecessary tray detection operations.

In one embodiment, the control unit omits the tray detection operation after printing the second of a plurality of target printing materials in a case where the newly acquired printing data includes content which performs printing with respect to a plurality of target printing materials using the same type of set tray.

In a case where the newly acquired printing data includes content that performs printing with respect to, for example, P sheets of target printing materials using the same type of set tray, the set tray type does not change when printing with respect to P sheets of target printing materials is executed.

Since the tray detection operation is omitted in such a case of the transition of the second of the P sheets of target printing material, it is possible to improve printing throughput by eliminating unnecessary tray detection operations.

In one example, when the tray detection operation is executed, the control unit performs printing in a case where the type of set tray specified in the newly acquired printing data and the type of set tray detected by the tray detection operation are the same. The control unit does not perform printing in a case where the types are different.

In a case where the tray detection operation is executed, printing is not performed in a case where the type of set tray detected by the detection operation and the type of set tray specified in the newly acquired printing data are different. Accordingly, it is possible to reduce the concern of printing being performed using the wrong type of set tray due to a user mistake in performing the set tray replacement task.

In one embodiment, a movement unit is provided that relatively moves at least one of the ink discharge unit and the set tray between a set position at which the target printing material is set or initially placed and a target printing material printing start position which interposes a printing execution region with the ink discharge unit. The tray detection operation is executed when at least one of the ink discharge unit and the set tray is relatively moved from the set position to the printing start position in a state where the target printing material is set.

Here, "printing start position" signifies the position from which the set tray starts movement with respect to a fixed ink discharge unit in order to print to a target printing material, or conversely, the position from which the ink discharge unit side starts movement with respect to a fixed set tray.

By providing a movement unit which relatively moves at least one of the ink discharge unit and the set tray between a set position at which the target printing material is set and a target printing material printing start position which interposes a printing execution region with the ink discharge unit, the tray detection operation can be executed at the same time by the detection unit in the relative movement from the set position of the set tray to the printing start position which is adopted after executing printing of the target printing material.

Accordingly, it becomes possible to efficiently detect the type of set tray using the relative movement process of the set tray by suppressing generation of the above problems based on a set tray mismatch, without increasing the time required for printing of target printing materials.

In one example, the speed of the relative movement from the set position to the printing start position can be faster when the tray detection operation is omitted than when the same detection operation is executed.

Accordingly, it is possible to improve the printing throughput.

According to one embodiment, the set tray may include a first target detection unit which is positioned at one side or the other side in the movement direction. When at least one of the ink discharge unit and the set tray is moved on the outside of a region occupied by the target printing material, in a state where the target printing material is set, detection of the type of set tray by the detection unit is performed based on the detection timing of the first target detection unit when at least one of the ink discharge unit and the set tray is relatively moved from the set position to the printing start position.

Here, "detection timing" signifies the timing for detecting the presence or absence of the first target detection unit. However, the detection timing is not limited to a case where the type of set tray is detected using a one time or single detection, but also includes a case where the type of set tray is detected by first target detection units located at a plurality of locations. The detection unit is detected a plurality of two or more times.

In one example, a first target detection unit is provided at a position to one side or the other side in the movement direction when at least one of the ink discharge unit and the set tray is moved on the outside of a region occupied by the target printing material in a state where the target printing material is set. Detection of the type of set tray by the detection unit is performed based on the detection timing of the first target detection unit when at least one of the ink discharge unit and the set tray is relatively moved from the set position to the printing start position. Accordingly, the position detection of the set tray in the relative movement direction can be performed using the detection timing of the first target detection unit. In so doing, in a state in which the target printing material is set, by the set tray being relatively moved in the movement direction only, it is possible to accurately specify the difference in the size and shape or the like of the set tray.

In one example, a second target detection unit may be provided which is positioned on at least one side in a direction intersecting the movement direction when at least one of the ink discharge unit and the set tray is moved on the outside of the region occupied by the printing material in a state where the target printing material is set in the set tray. Detection of the type of set tray by the detection unit is performed based on the detection timing of the first target detection unit when at least one of the ink discharge unit and the set tray is relatively moved from the set position to the printing start position, and detection information obtained by relatively moving the detection unit in a direction which passes through the second target detection unit.

Position detection in the left and right width direction when the movement direction of the set tray is set to the front to rear direction can be performed using the detection information of the second target detection unit. In so doing, as length of the set tray in the movement direction is the same, it is possible to detect a difference in types with different lengths in the width direction.

In so doing, on the basis of the detection timing information with respect to the first target detection unit, and detection information with respect to the second target detection unit, it is possible accurately specify the difference in the size and shape of a set tray in a printing apparatus with a structure that replaces more types of set tray.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Figure 1:
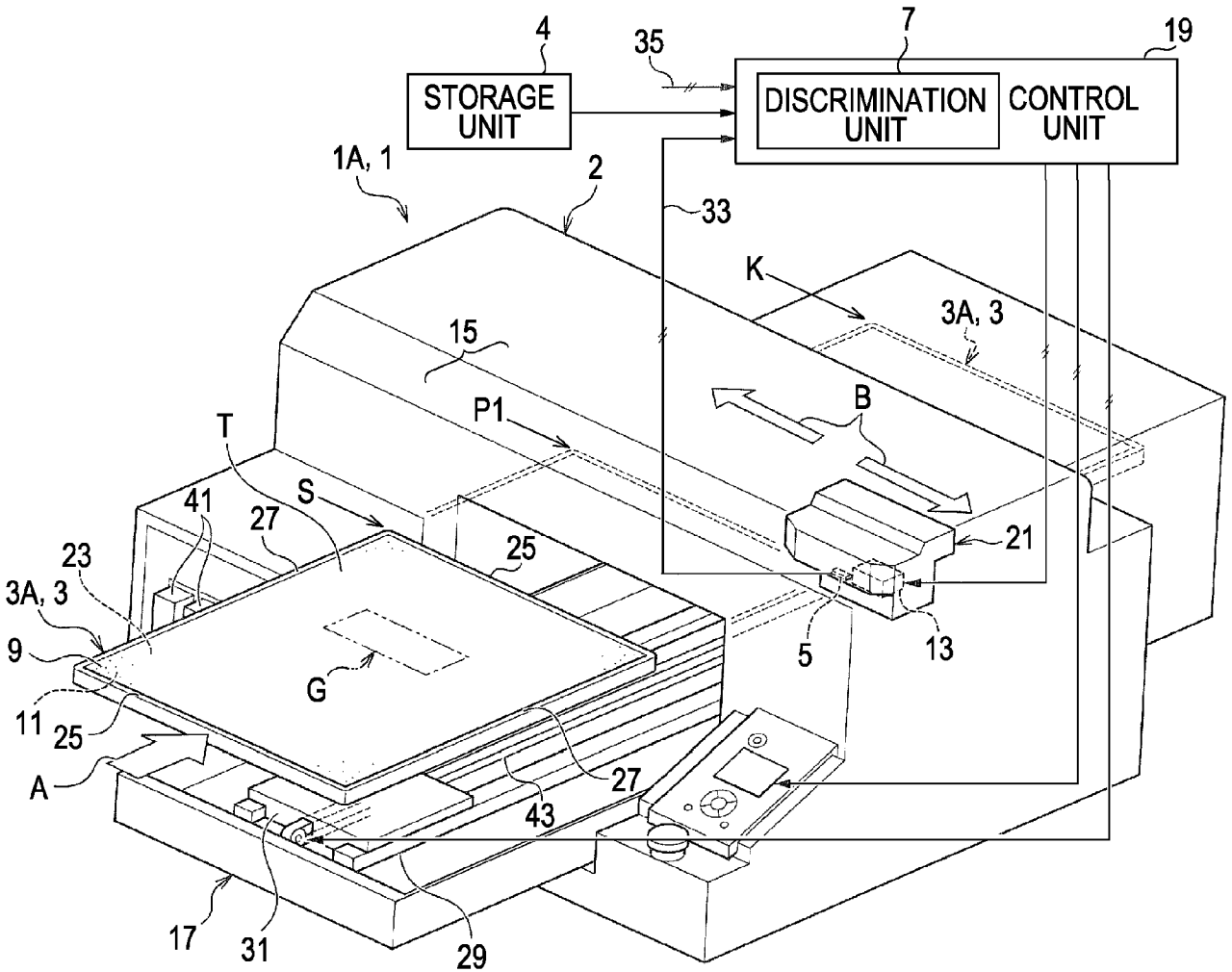
FIG. 1 is a perspective view illustrating a schematic configuration of an embodiment of an ink jet textile printing apparatus.
Figure 2:
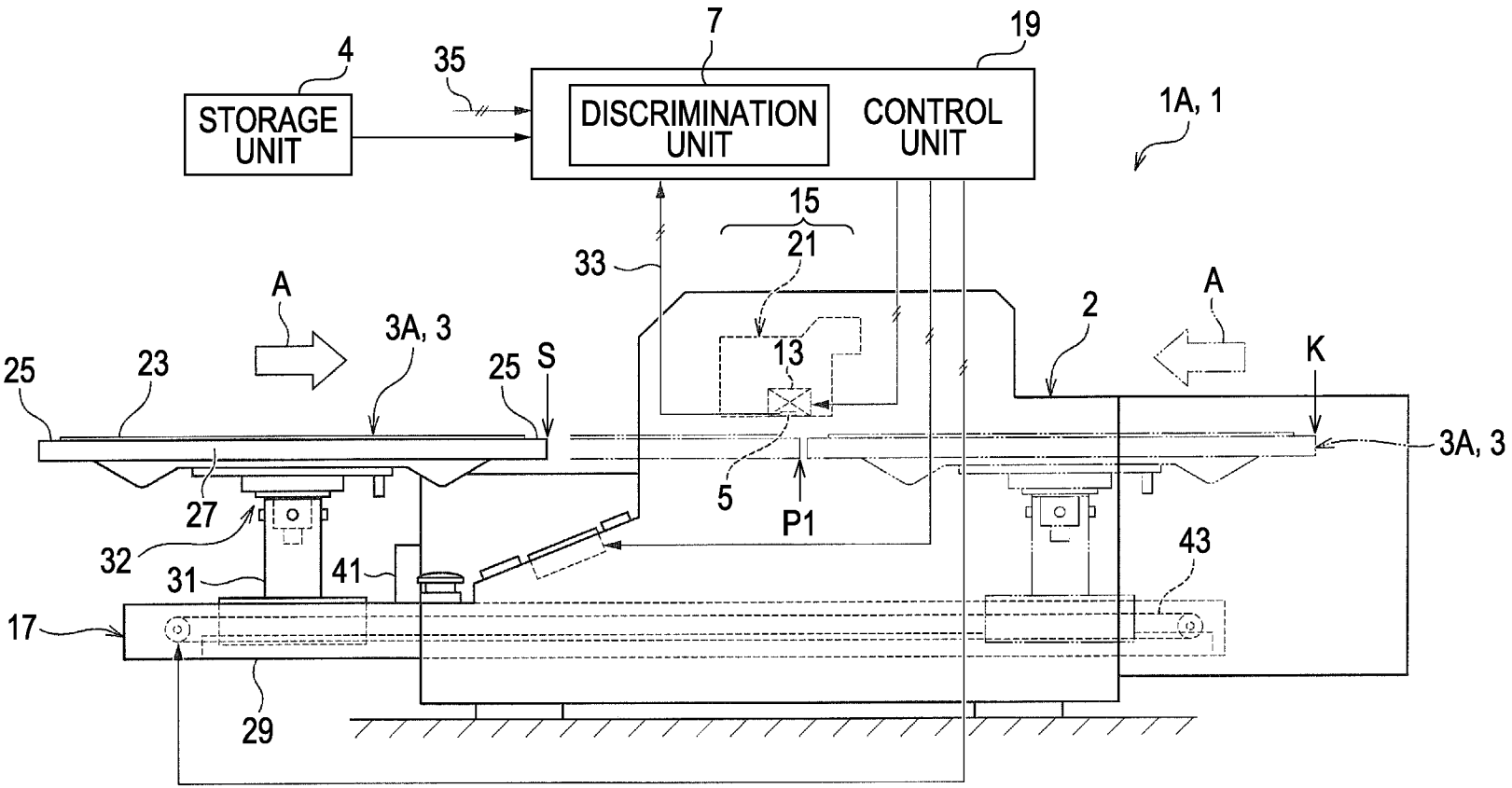
FIG. 2 is a cross-sectional side view illustrating a schematic configuration of the ink jet textile printing apparatus shown in FIG. 1.

Embodiments of the invention relate to a printing apparatus and to the methods for printing as described below.

A target printing material T (also referred to herein as a "fabric") is discussed herein. A T-shirt is an example of a target printing material T. In one example of a T-shirt, the torso portion and the sleeve portion are sewn in a cylindrical shape. The surface on the front side of the T-shirt on which a printing image G is formed will be described as a first surface 9, and the surface on the rear side of the T-shirt, which is the opposite side of the first surface 9, will be described as a second surface 11.

FIGS. 1-7 illustrate one example. The textile printing apparatus illustrated in FIGS. 1-7 is an ink jet textile printing apparatus 1A. The ink jet textile printing apparatus 1A is provided with a replaceable set tray 3 on which the target printing material T is set, an ink discharge unit 13 that prints by discharging ink to the target printing material T according to printing data 35, a storage unit 4 which stores the type of set tray 3 specified in printing data 35 during execution of printing or while printing on the target printing material T, a detection unit 5 that detects the type of set tray 3 and a control unit 19 which controls a tray detection operation. The detection unit 5 may detect the type of set tray 3 before printing on the target printing material T.

The control unit 19 is configured to compare the type M of set tray 3 specified in newly acquired printing data 35 and type N of set tray 3 stored in the storage unit 4. In a case where the types are different ($M \neq N$), a tray detection operation is performed. In a case where the types are the same ($M=N$), the tray detection operation is omitted.

Each of the constituent parts of the ink jet textile printing apparatus 1A are described in detail below.

The ink jet textile printing apparatus 1A includes a tray attaching unit 32 (FIG. 2) that can attach to a plurality of types of set tray 3, a detection unit 5 that can detect the type of set tray 3 which is attached to the tray attaching unit 32 in a state where the target printing material T is set, and a discrimination unit 7 which discriminates or determines whether the type of set tray 3 detected by the detection unit 5 and the type M of set tray 3 specified in the newly acquired printing data 35 match or mismatch. The ink jet textile printing apparatus 1A also includes a control unit 19 which performs a predetermined operation based on the result of the discrimination performed by the discrimination unit 7.

The ink jet textile printing apparatus 1A further includes an ink discharge head 13 (the ink discharge unit) that forms a printing image G by discharging ink to the target printing material T, a movement unit 17 that is moved between a set position S at which the set tray 3 and the target printing material T is set or loaded and a printing starting position K of target printing material T that interposes the printing execution region 15 with the ink discharge head 13. Then, the detection unit 5 detects the type of set tray 3 when the set tray 3 is moved from the set position S to the printing start position K in a state where the target printing material T is set. The detection unit 5 may detect the type of set tray 3 before the set tray 3 reaches the printing start position K.

More specifically, the textile printing apparatus 1A includes an ink discharge head 13 which forms the desired printing image G by discharging ink to the first surface 9 of the target printing material T, a set tray 3 on which the target printing material T is set or placed and which supports the second surface 11 of target printing material T, and a movement unit 17 which is reciprocated between the set position S at which the set tray 3 and target printing material T are set and the printing start position K of the target printing material T, which printing start position K is located in the printing execution region 15 where the ink discharge head 13 is present.

Then, the control unit 19 is configured such that when the discrimination result of the discrimination unit 7 is a "mismatch", printing is not executed and, as one predetermined operation, the set tray 3 is returned to set position S. Further, in the present embodiment, when the discrimination unit 7 determines a "mismatch", the user is further notified of the mismatch or notified that the type of set tray 3 does not match.

Moreover, in the ink jet textile printing apparatus 1A according to Embodiment 1, as shown in FIG. 1, the ink discharge head 13 is held in the apparatus main body 2 in a state of being movable in the scanning direction B. The scanning direction B is a direction which intersects the movement direction A of the set tray 3. More specifically, the ink discharge head 13 is mounted on a carriage 21, which is reciprocally movable in the scanning direction B within the apparatus main body 2. The detection unit 5 is provided on the carriage 21 in one example.

In this example, the set tray 3 moves in the movement direction A, and the detection unit 5 adopts a fixed structure with respect to the movement direction A. The detection unit 5 is not limited thereto. The set tray 3 may be fixed in position without moving in the movement direction A, and a state corresponding to the set position S and a state corresponding to the printing start position K may be realized by having the apparatus main body side 2 that holds the detection unit 5 move. In other words, the carriage 21 is moved in the direction A while the set tray 3 is fixed.

The relationship of detection unit 5 and set tray 3 with respect to the direction A is sufficient if the relationship is one of relative movement. Thus, it is also possible to realize a state corresponding to the printing start position K and a state corresponding to the set position S by moving both the detection unit 5 and/or the set tray 3.

In other words, the relationship of the detection unit 5 and the set tray 3 that establishes the printing start position K and the set position S can be achieved by having the set tray 3 move while the detection unit 2 is fixed, by having the detection unit 5 move while the set tray 3 is fixed, or by having both the detection unit 5 and the set tray 3 both move.

In addition, the set tray 3 is provided with first target detection units 25 and 25 which are positioned on the front side and the rear side in the movement direction A of set tray 3 outside of the region occupied by the target printing material T, in a state where the target printing material T is set in the set tray 3. In other words, in a state where the target printing material T is set in the set tray 3, the first target detection units 25 and 25 are positioned on the front side and the rear side in the movement direction A of the set tray 3 outside of the peripheral portion of the region occupied by the target printing material T. The target detection units 25, 25 are placed or set in a state where they are exposed to the ink discharge unit 13 side. Then, detection of the type of set tray 3 according to the detection unit 5 is performed based on the detection timing of the first target detection units 25 and 25 when the set tray 3 is moved from the set position S to the printing start position K. In other words, the timing of the detection of the target detection unit 25 on the front side can be used to determine the type of set tray attached to the printing apparatus.

Furthermore, the various members mentioned above which configure the ink jet textile printing apparatus 1A according are further described.

The ink discharge head 13, as an example, is a printing execution member which directly discharges ink, which is supplied via a tube or the like from ink cartridge 41 positioned on the left side facing the apparatus main body 2 in this example, toward the first surface 9 of target printing material T. The ink discharge head 13 performs printing. And, in one embodiment, a so-called serial type ink discharge head, which discharges ink while the carriage 21 reciprocates in the scanning direction B, is adopted as an example of the ink discharge head 13.

The set tray 3, using a rectangular, flat plate-like member as an example, is formed with a flat set surface 23. A target printing material T is set on the upper surface. The set surface 23 is a site that directly supports the second surface 11 of the target printing material T, and is formed as flat surface over the entire surface such that the target printing material T may be smoothed out and set in the set tray 3.

On the front and back of the periphery the set surface 23, first target detection units 25 and 25 are formed as a pair in a structure which becomes a part of the frame body 28 which extends in the lateral direction. In addition, in the lateral direction of the periphery of the set surface 23, second target detection units 27 and 27 are formed as a pair in a structure that becomes a part of the frame body 28 which extends in the longitudinal direction. The second target detection units 27 and 27 can also be used to detect the type of set tray 3 as described below.

In other words, the first target detection units 25 and 25 and the second target detection units 27 and 27 are integrated with the rectangular frame body 28. The frame body 28 is fitted and attached to the periphery in order to hold the smoothened state of the target printing material T, on which smoothing has been performed, in a state of being set or placed on the set tray 3. The frame body 28 in the present invention is an example of a target detection unit which is detected by the detection unit 5.

The first detection units 25 and 25 and the second target detection units 27 and 27 are formed from an appropriate material with high light reflectivity, such as a metal. The first target detection units 25 and 25 are used to detect the position in the length direction, along the direction of movement A of the set tray 3, and the second target detection units 27 and 27 are used to detect the position in the width direction of the set tray 3. The first target detection units 25 and 25 can be used to measure a length of the set tray 3 and the second target detection units 27 and 27 can be used to measure a width of the set tray 3.

Figures 4A, 4B, 4C:
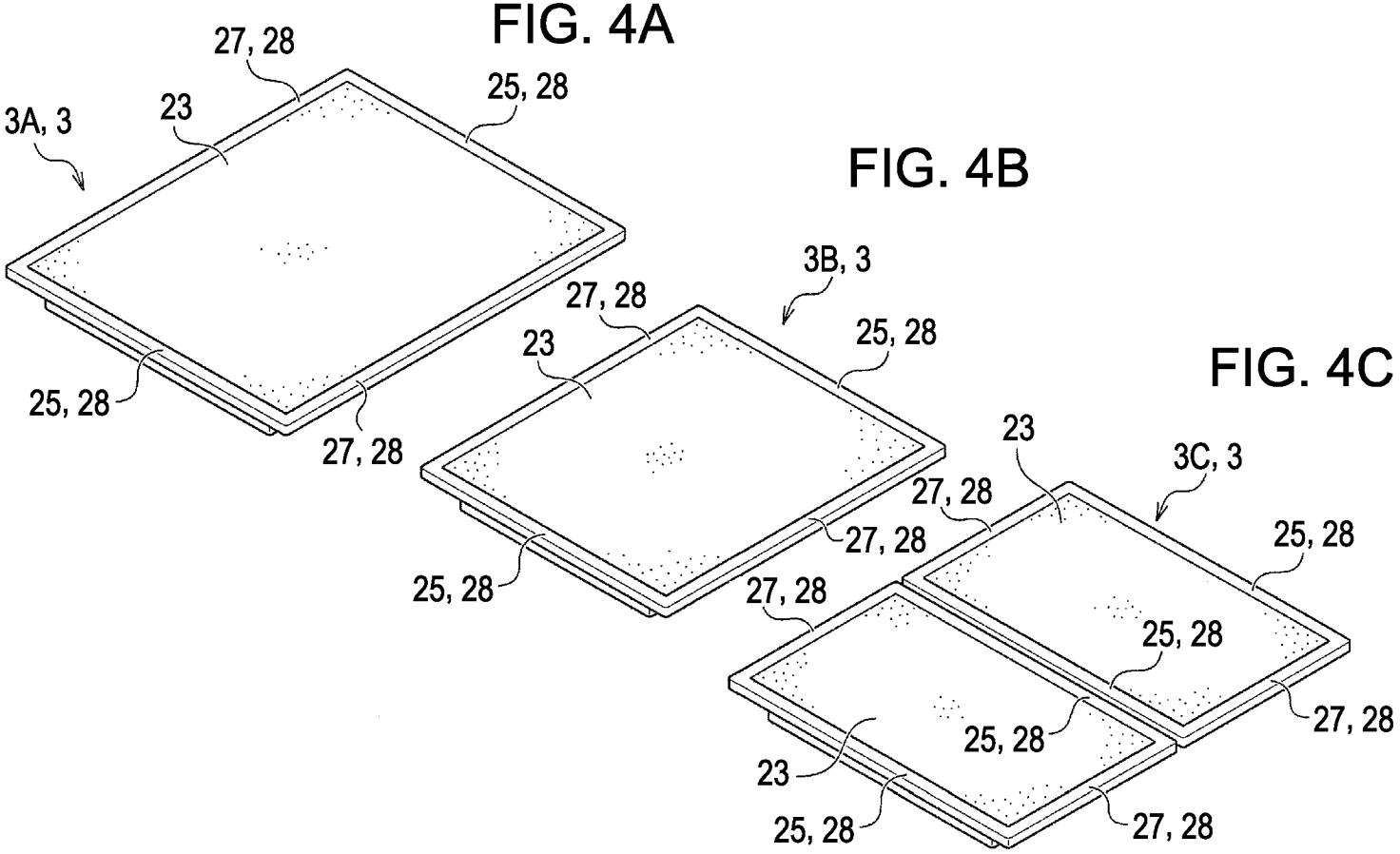
FIGS. 4A to 4C are bottom views of a carriage illustrating the disposal location of the detection unit and an ink discharge unit of the ink jet textile printing apparatus shown in FIG. 1.

FIGS. 4A to 4C illustrate three example types of set trays. The set tray 3A shown in FIG. 4A is a suitably large-sized set tray 3 for a large-sized target printing material T or when the printing image G covers a large range.

The set tray 3B shown in FIG. 4B is a suitably small-sized set tray 3 for a small-sized target printing material T and when the printing image G is finished over a narrow range. In one example, the set tray 3C shown in FIG. 4C may have the same width dimension as the set tray 3A illustrated in FIG. 4A, and two of the set trays 3 with a length dimension approximately half that of the set tray 3A illustrated in FIG. 4A may be combined and arranged in the longitudinal direction. The set tray 3C is a set tray 3 with an appropriate different shape for a small-sized target printing material T or when two sheets of a target printing material T with a small printing image G are set at the same time and printing is performed.

The movement unit 17 is configured, in one example, with a support base 29 extending along the movement direction A between the inner side from the front of the apparatus main body 2 of the ink jet textile printing apparatus 1A. Above support base 29 as an example in the central portion of the lateral direction, a support table 31 having a slider that capable of reciprocating along the movement direction A and a strut of a predetermined height is provided. A drive mechanism includes a timing belt 43. The timing belt 43 may drive the support table 31.

Further, on the upper surface of the support table 31, the above-described set tray 3 is attached to the tray attaching unit 32 in a removable state to be matched with a center standard. Then, the set tray 3 is configured so as to be integrated with the set target printing material T and the support table 31 and move along the movement direction A. The set tray 3 is then able to reciprocate between the above-described set position S and the printing start position K.

Figure 3:
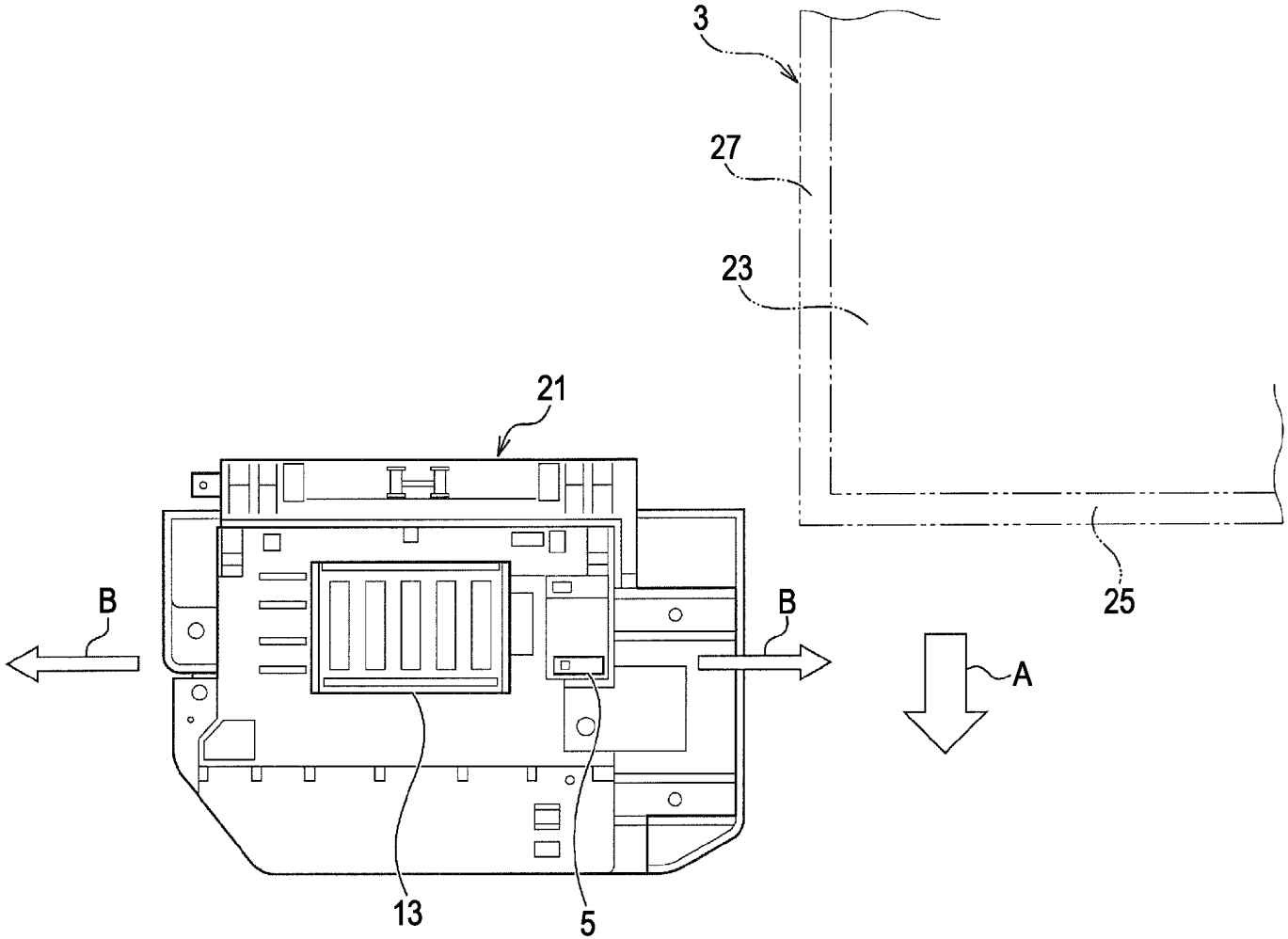
FIG. 3 is a plan view illustrating a schematic configuration of the ink jet textile printing apparatus shown in FIG. 1.

A reflection type optical sensor may be applied as an example of the detection unit 5. The detection unit 5 is disposed on the bottom surface of the carriage 21 near the side of the ink discharge unit 13, as shown in FIG. 3 for example.

Further, the light emitted downward from the detection unit 5, hits the above-described first target detection unit 25 and second target detection unit 27 and reflects. Position detection of the set tray 3 is performed in the width direction and in the length direction of the set tray 3 by sensing the light that returns or that is reflected to the detection unit. The type of set tray 3 can be specified based on the position detection of the set tray 3.

The discrimination unit 7, on the basis of comparing the type M of set tray 3 that is specified in newly acquired printing data 35 that is set by a user, and type information 33 of the set tray 3 sent from the detection unit 5, compares both types and discriminates between a match and a mismatch in the type of set tray.

Then, in the case where a match for set tray 3 has been confirmed by the discrimination unit 7, the set tray 3 is used for executing printing with respect to the target printing material T. In other words, the set tray 3 is acceptable for the printing process.

The control unit 19 executes the process described below when the discrimination unit 7 confirms a mismatch. That is, the execution of printing or the printing process which uses the set tray 3 is stopped, and a caution process (broadcast process) is performed. The caution or broadcast process informs the user through sound or display of the mismatch in the type of set tray 3.

In addition, the caution process is executed at the same time as a discharge process. The discharge process return the set tray 3, which is at the printing execution region 15, the printing starting position K or the like, to the set position S and prompts replacement of the set tray 3.

Figure 6:
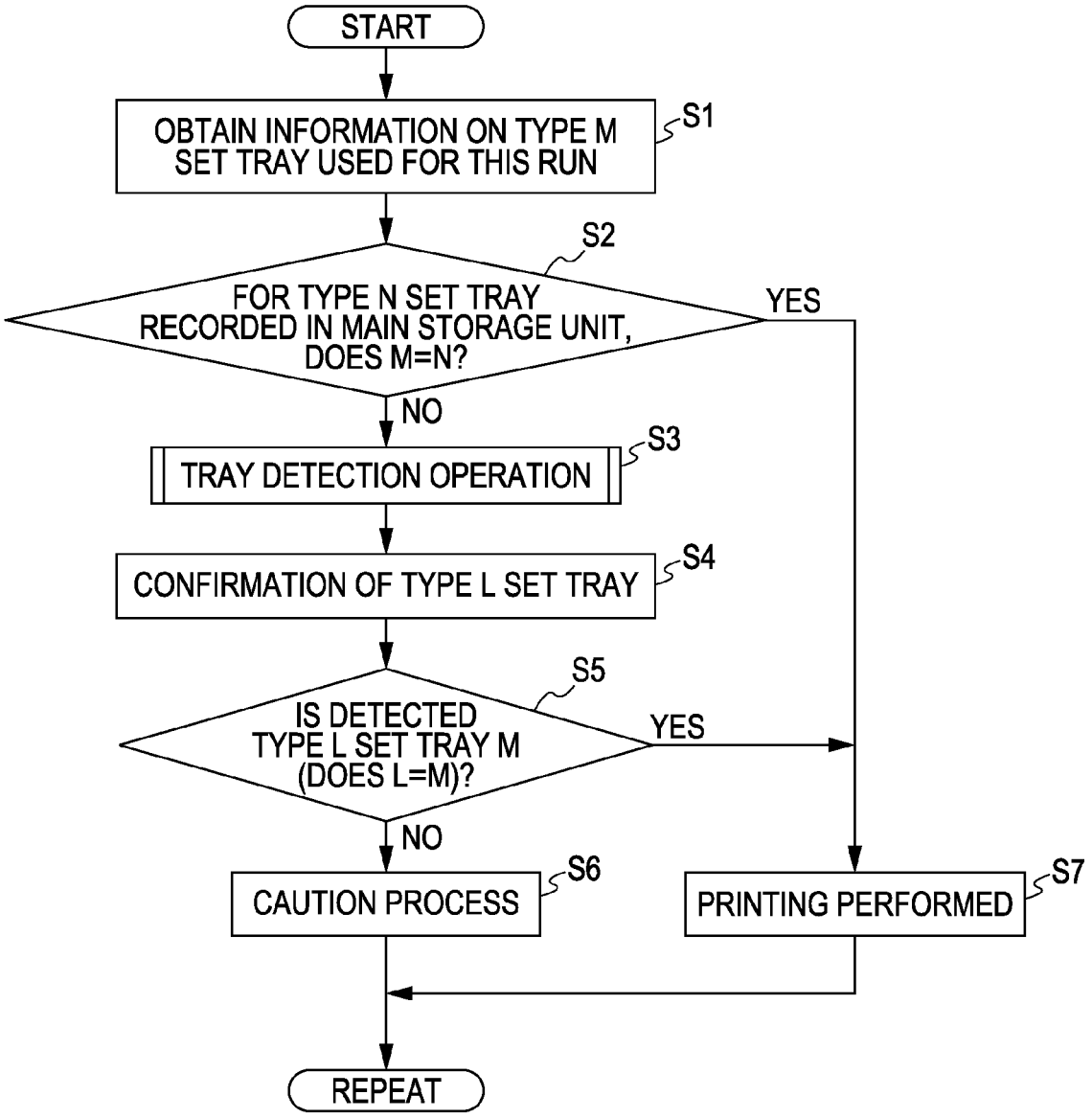
FIG. 6 is a flowchart explaining a control flow of the control unit of the ink jet textile printing apparatus shown in FIG. 1.

Next, the control flow of a control unit 19, which controls whether to perform or omit a tray detection operation, will be described based on FIG. 6.

First in step S1, the control unit 19 obtains information of the type M of set tray used in the current printing or in the current printing process. This is performed by the user inputting printing data 35 which include information on the type M of the set tray via the driver from external equipment such as a personal computer. The information of the type M can be determined from the printing data 35. Thus, information on the type M set tray used for the run or printing process is determined.

Then, the process proceeds to step S2, the type M of set tray 3 specified in the newly acquired printing data 35 is compared with the type N of set tray 3 stored in the storage unit 4. When the result of the comparison is that the types are different (M≠N), the process advances to step S3 and executes the tray detection operation. The details of the tray detection operation will be described later.

The storage unit 4 stores the type M of set tray 3 specified in the printing data 35 during the execution of printing or while the printing process is occurring or before the actual printing occurs. That is, the type N of set tray 3 stored in the storage unit 4 becomes type M since the type M specified in the printing data 35 is stored in the storage unit 4. The type of set tray stored in the storage unit 4, being type M of set tray 3, is used in executing printing. Accordingly, the type N is updated with the type M for each execution of printing or for each print run.

The type L of set tray 3 that is currently attached to ink jet textile printing apparatus 1A (step S4) is determined by performing the tray detection operation.

Next, the process proceeds to step S5, and a determination is made as to whether or not the detected type L of set tray 3 and the type M of set tray 3 specified in the printing data 35 are the same. In a case where the types are not the same (L≠M), a mismatch is found and the process proceeds to step S6. A caution process notifying the user of this fact is performed in step S6.

On the other hand, in step S2, the tray detection operation is omitted when the types are the same (M=N). The process then proceeds to step S7 and printing is performed. Further, in step S5, in a case where the types (e.g., detected type of set tray and type of set tray identified in the printing data 35) are the same (L=M), the tray detection operation is omitted, the process advances to step S7 and printing is performed.

As described above, the control unit 19 compares the type M of set tray 3 specified in newly acquired printing data 35 and type N of set tray 3 stored in the storage unit 4. When the types of tray are different (M≠N), the control unit performs the tray detection operation. Accordingly, by executing the tray detection operation, it is possible to ascertain the type L of set tray 3 that is actually attached in the ink jet printing apparatus. In so doing, it becomes possible to determine whether or not the correct type of set tray (L=M or L≠M) is attached. In the case where the correct type of set tray (L=M) is attached, printing is performed as is, and in the case where the wrong type of set tray (L≠M) is attached, by not executing printing or by not printing, it is possible to reduce the concern of executing printing with the wrong type of set tray 3 attached. In other words, embodiments of the invention can ensure that the correct type of set tray is attached to the printing apparatus before the printing process is actually performed. Embodiments of the invention can ensure that the correct type of set tray is attached not only by comparing the type of set tray in the printing data with the type of set tray stored in the storage unit, but also by confirming the type of set tray actually attached to the ink jet printing apparatus when the type of the set tray in the printing data does not match the type of set tray recorded in the storage unit.

Further, from the results of the comparison of the newly specified type M of set tray 3 included in the printing data and the type N of set tray 3 stored in the storage unit, the replacement task for the set tray 3 is not performed when both types are the same (M=N) because it is not necessary and there is no concern that the wrong set tray 3 is attached to the ink jet printing apparatus. Because the tray detection operation is omitted, it is possible to improve printing throughput by eliminating unnecessary tray detection operations.

Further, in a case where the tray detection operation is executed and it is determined that the type L of set tray 3 detected by the detection operation and type M of set tray 3 specified in newly acquired printing data 35 are different, printing is not performed. Advantageously, it is possible to reduce the concern of executing printing or of performing a printing process with wrong type of set tray 3 due to a mistake in the set tray replacement task that was performed by the user.

In another example, the control unit 19 is configured to perform the tray detection operation in a case of content in which the newly acquired printing data 35 includes settings related to the type M of set tray, and omit the tray detection operation in a case where the content does not include the settings.

Here, newly acquired printing data 35 is content which includes settings related to the type of set tray 3" is basically that the settings change the type of type M of set tray 3 specified in the printing data 35 to a different type. However, even if the type of set tray 3 is ultimately not changed, for example, in a case where a change operation is executed but is returned to the original for any reason once the intention changes, since the possibility of the replacement task for the wrong type of set tray 3 being performed is high, a case where the setting operation of a portion related to the change is executed including such a case is made to also include setting operation in the "printing data is content which includes settings related to the type of set tray" then in reducing the concern of executing printing with the wrong type of set tray 3 attached, reliability may be increased.

According to this example, the control unit 19 performs the tray detection operation in a case where the newly acquired printing data 35 is content which includes settings related to the type M of set tray 3 and omits the tray detection operation in a case where the content does not include the settings. Accordingly, it is possible to reduce the concern of executing printing with the wrong type of set tray attached by executing the tray detection operation.

In addition, as a result of the comparison, in a case where newly acquired printing data 35 is content which contains settings related to the type of set tray 3, since the replacement task for set tray 3 is not necessary, there is not a state where the wrong type of set tray 3 is attached to printing apparatus 1. Since the tray detection operation is omitted in this case, it is possible to improve printing throughput by eliminating unnecessary tray detection operations.

In another example, the control unit 19 is configured so as to omit the tray detecting operation for each of the target printing materials T in the transition to the second sheet from among the P sheets of target printing material, in a case where the newly acquired printing data 35 includes the content with respect to printing a plurality of P sheets of the target printing material T using the same type of set tray.

In a case where newly acquired printing data 35 includes content which performs printing with respect to a plurality of P sheets of the target printing material T using the same type of set tray 3, when printing is performed with respect to the P sheets of target printing material T, the type of set tray does not change and the tray detection operation can be omitted.

In addition, since the tray detection operation is omitted in such a case, it is possible to improve printing throughput by eliminating unnecessary tray detection operations.

Further, the movement speed of the set tray 3 from the set position S to the printing start position K is configured to be faster when the tray detection operation is omitted compared to when the tray detection operation is executed. In so doing, it is possible to increase the printing throughput since unnecessary operations are omitted.

Next, an example of the tray detection operation will be described in detail.

Figure 5A:
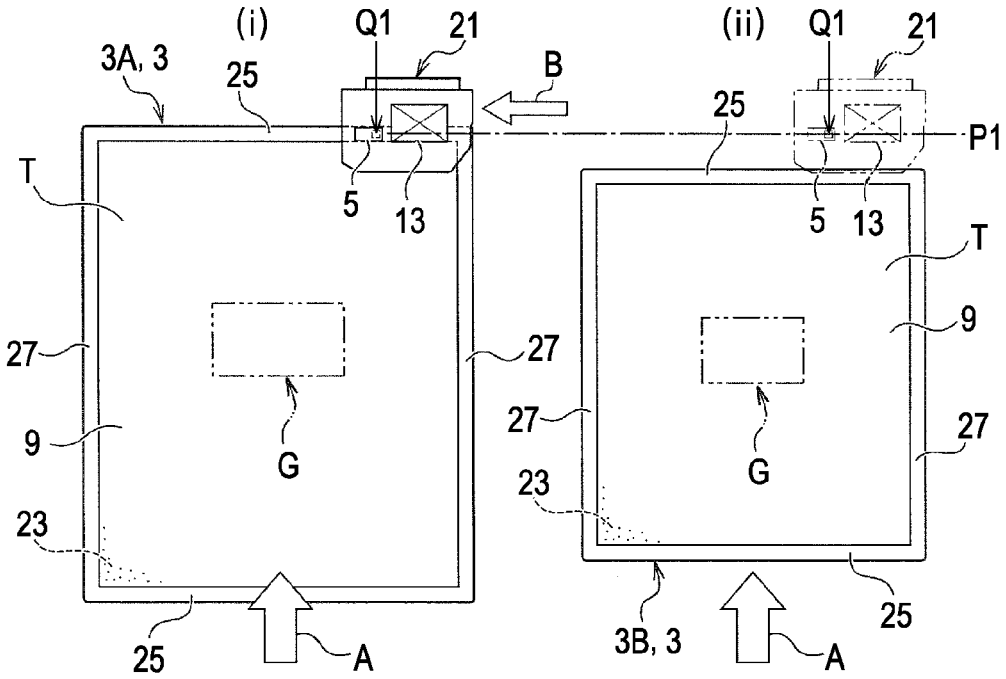
FIGS. 5A and 5B are perspective views illustrating the type of set tray used in the ink jet textile printing apparatus shown in FIG. 1.

The ink jet textile printing apparatus 1A is configured so as to perform a set tray first movement in which the set tray 3 on which the target printing material T is set is moved by the detection unit 5 to a first position P1. The first position P1 is a position at which the first target detection unit 25 on the rear side (inner side in the movement direction) is detectable (FIG. 5A). A set tray second movement in which the set tray 3 which has been moved to the first position P1 is moved to a second position P2. The second position P2 is a position in which the first target detection unit 25 on the front side (forward side in the movement direction) of the set tray 3C is detectable (FIG. 5B (i)). The type of set tray 3 can be specified on the basis of the detection information detected in each movement. The control unit 19 discriminates between a match and a mismatch by comparing the type L of set tray 3 specified on the basis of the detection information and the type M of set tray 3 specified in the newly acquired printing data 35.

Below, an example of a detection procedure for detecting the type of set tray 3 is described, and an example of an operation flow during detection is described in detail with reference to FIGS. 5A and 5B and FIG. 7.

The target printing material T is set or loaded on the set surface 23 of set tray 3 positioned at set position S and smoothed out. After frame body 28 is fitted to the set tray 3, the user inputs the printing data 35, which includes the type M of set tray 3 used, as a printing execution command from the external equipment.

Figure 7:
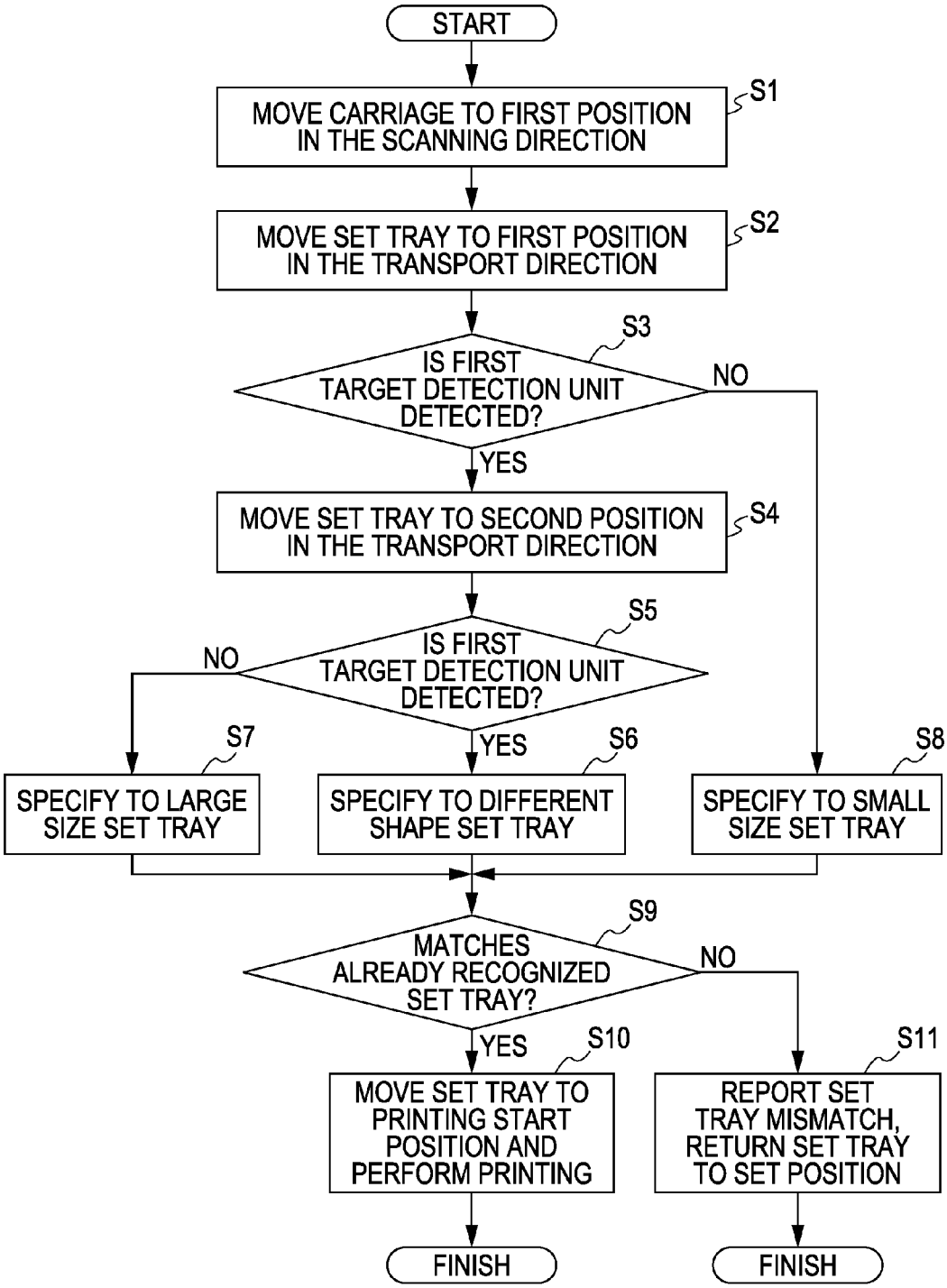
FIG. 7 is flowchart explaining the tray detection operation in ink jet textile printing apparatus shown in FIG. 1.
Figure 8:
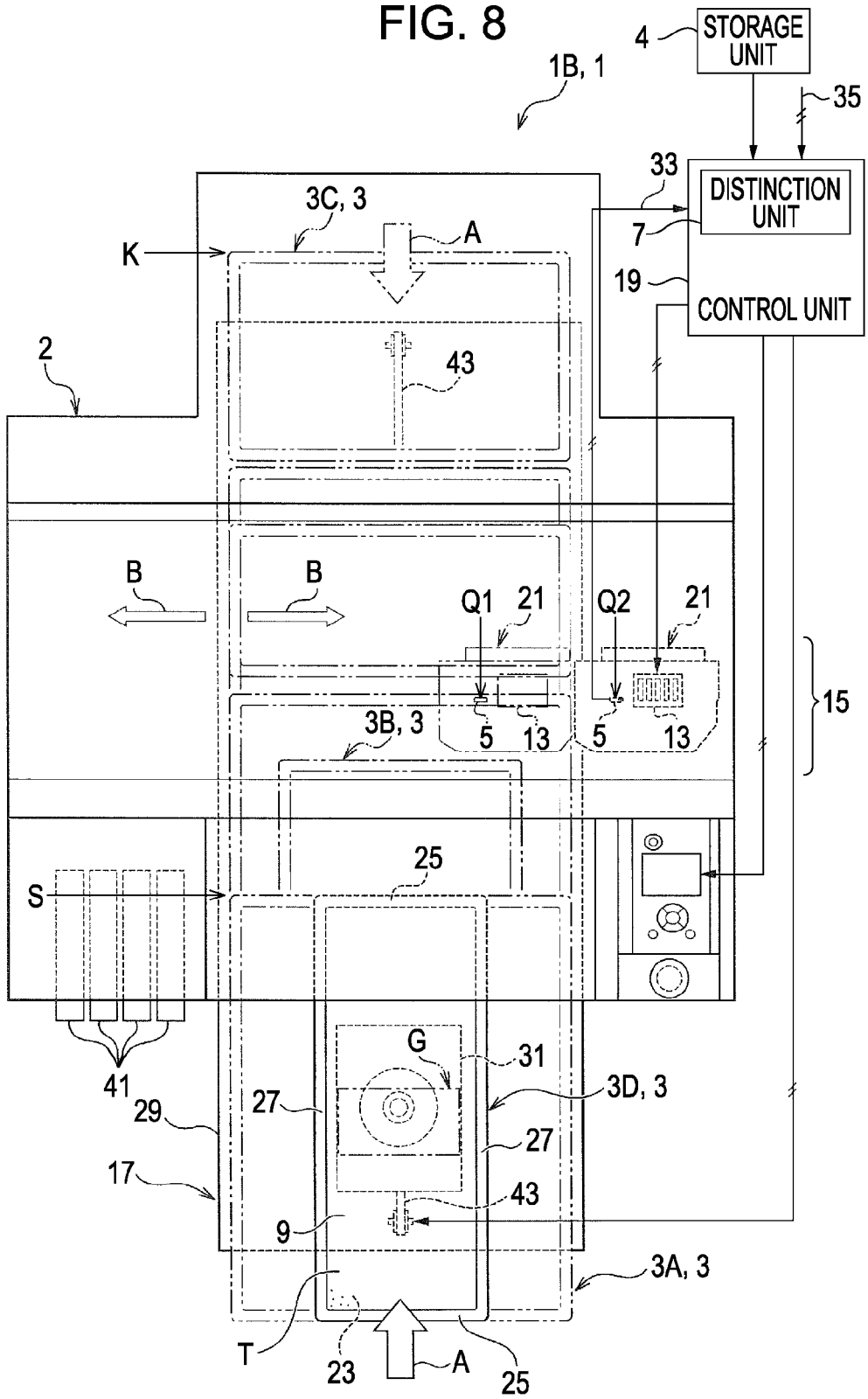
FIG. 8 is a plan view illustrating a schematic configuration of another embodiment of an ink jet textile printing apparatus.

Then, the printing execution command is received, and the detection and discrimination operations for the set tray 3 are started using the flow diagram illustrated in FIG. 7.

First, the carriage 21 is moved to the first position Q1 in the scanning direction in step S1. Next, moving to step S2, movement unit 17 drives and the set tray 3 to move the set tray 3 to a first position P1 in the movement direction. Here, in the timing at which the set tray 3 moves to first position P1, when using the large-sized set tray 3A and when using the set tray 3C, which has a different shape than the set tray 3A, the first target detection units 25 on the rear side of set trays 3A and 3C are positioned below the detection unit 5 as shown in (i) in FIG. 5A.

On the other hand, when using the small-sized set tray 3B, the first target detection unit 25 of set tray 3B has not reached the detection unit 5 and is not yet below the detection unit, as shown in (ii) in FIG. 5A.

Next, returning to FIG. 7 and moving to step S3, a determination is performed as to whether first target detection unit 25 is detected. The determination may be made when the detection unit 5 positioned in the first position Q1 in the scanning direction is moved to the first position P1. Then, in a case where the detection of the first target detection unit 25 is confirmed, the process moves to step S4. In step S4, the movement unit 17 is again driven and the set tray 3 is moved to a second position P2 in the movement direction.

Figure 5B:
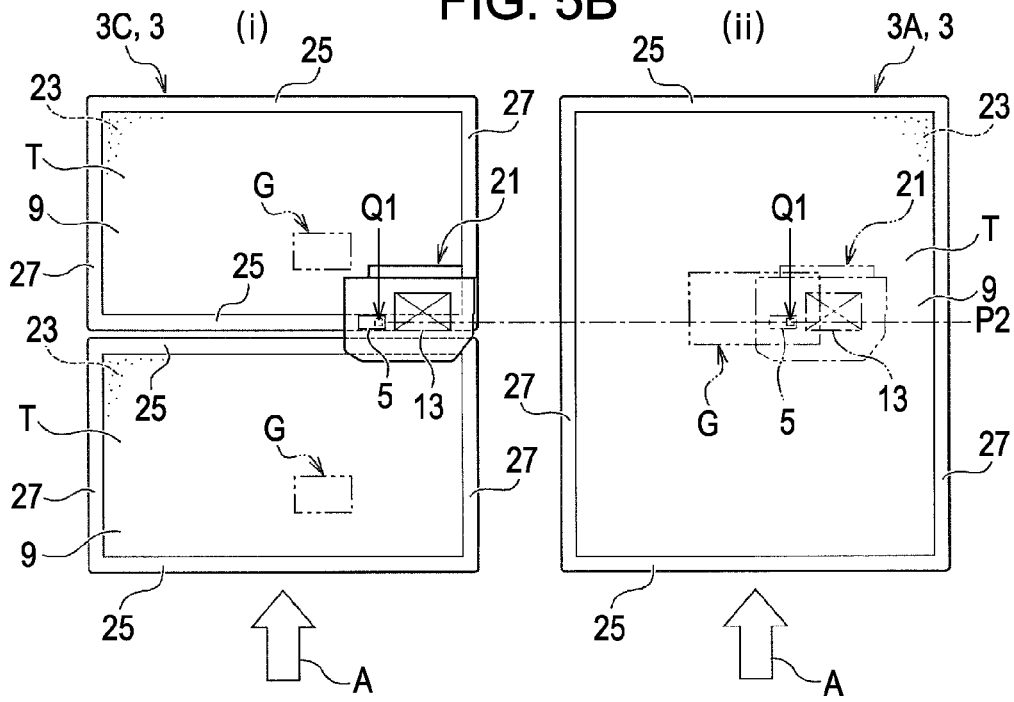

Note that, in the second position P2 in the movement direction, when using the set tray 3C, which has a different shape compared to the set tray 3A and the set tray 3B, setting is performed so as to confirm the first target detection units 25 of the set trays 3C and the gap between the front and back set trays 3C by the detection unit 5 as shown in (i) in FIG. 5B. On the other hand, when using large-sized set tray 3A, since the first target detection unit 25 and the gap are not present as shown in (ii) in FIG. 5B, the types are not confirmed.

Next, returning to FIG. 7, determination as to whether the first target detection unit 25 is detected in step S5 is performed, and in a case where the first target detection unit 25 was detected, the process moves to step S6 and the set tray 3C with a different shape is specified.

Further, in a case where it is determined that first target detection unit 25 was not detected in the step S5, the process moves to step S7 and large-sized set tray 3A is specified. In this example, detecting the first target detection unit enables the printing apparatus to distinguish between the set type 3A and the set type 3C in one example.

In addition, in a case where it is determined that the first target detection unit 25 was not detected in the step S3, the process moves to step S8 and small-sized set tray 3B is specified.

Next, the process moves to step S9, and a determination is performed to determine whether the detected type L of set tray matches the type M of set tray 3 that is specified in newly acquired printing data 35. In a case where a match is determined (L=M), the process moves to step S10. In step S10, the movement unit 17 is driven and the set tray 3 is moved to the printing start position K and printing is performed.

On the other hand, in step S9, if it is determined that the types do not match (L≠M), the process moves to step S11. In step S11, the notification of the mismatch in the set tray 3 is made, the movement unit 17 is driven in the reverse direction, and the set tray 3 returns to the initial set position S.

By using the ink jet textile printing apparatus 1A in this manner, it is possible to decrease the occurrence of quality defects caused by a mismatch in the set tray 3. More specifically, in the process of moving the set tray 3 from the set position S to the printing start position K, since a detection of the type of set tray 3 is performed, there is no time taken for a separate discrimination of the type of set tray 3. As a result, efficient detection and discrimination of the type of set tray 3 is performed.

FIGS. 8-11 illustrate further example of an ink jet textile printing apparatus and methods of operation. The ink jet textile printing apparatus 1B has the same configuration as the ink jet textile printing apparatus 1A described above, and differs only in an increase by one of the types of set tray 3 that can be detected, and the determination and detection methods of the set tray 3 that become necessary along with the expansion of the types of the set tray 3. Generally, embodiments of the invention can be adapted to detect multiple types of set trays.

Therefore, the explanation herein centers on the detectable type of set tray 3, and the process of detection and determination of the type of set tray 3 by the ink jet printing method performed using the ink jet textile printing apparatus 1B.

That is, the ink jet textile printing apparatus 1B is configured to perform a carriage first movement in which a carriage 21 mounted on detection unit 5 is moved to first position Q1 in the scanning direction. The first position Q1 becomes the detection position. The set tray 3 on which the target printing material T is set is moved to first position P1 in the movement direction which becomes the detection position by a set tray first movement. A set tray second movement in which the set tray 3 moved to first position P1 in the movement direction is to move the set tray 3 to a second position P2 in the movement direction which becomes the detection position. A carriage second movement in which the carriage 21 moved to first position Q1 in the scanning direction is performed to move the carriage 21 to second position Q2 in the scanning direction which becomes the detection position. The type of set tray 3 is then specified based on the detection information detected in each movement, and a match or mismatch of the set tray is discriminated through comparison of both the type of set tray 3 specified in the specifying and the type of set tray 3' identified in advance.

Therefore, a carriage second movement is to the process executed by the ink jet textile printing apparatus 1A would enable additional types of set trays to be discriminated.

Figures 9A, 9B, 9C, 9D:
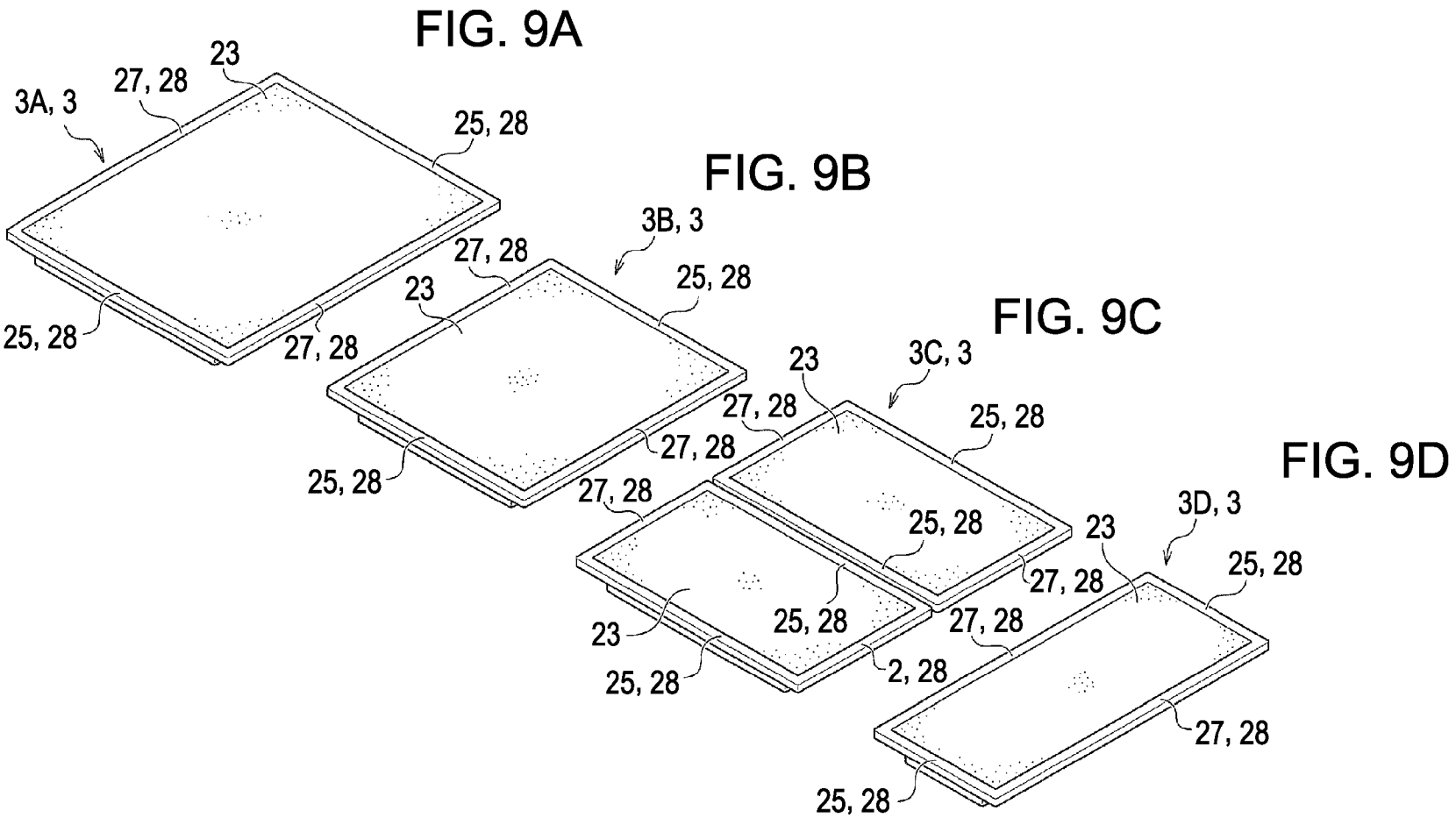
FIGS. 9A to 9D are perspective views illustrating the type of set tray for use with the ink jet textile printing apparatus in FIG. 8.

FIG. 9D illustrates another example of the set tray 3. The type of set tray 3 in FIG. 9D illustrates the configuration of a narrow set tray 3D which has about half the width dimension of the large-sized set tray 3A shown in FIG. 9A. The large-sized set tray 3A is shown in FIG. 9A, the small-sized set tray 3B is shown in FIG. 9B and the set tray 3C with a different shape is shown in FIG. 9C. The set trays in FIGS. 9A-9C have the same configurations as the set trays 3 shown in FIGS. 4A to 4C.

Below, an example of the detection procedure of the type of set tray 3, and an example of the operation flow during detection are described with reference to FIGS. 10A to 11.

Target printing material T is set on the set surface 23 of the set tray 3 positioned at set position S, and smoothed. After a frame body 28 is fitted to the set tray 3, the user inputs the printing data 35, which includes the type M of set tray 3 which is used, as a printing execution command from external equipment.

Figure 11:
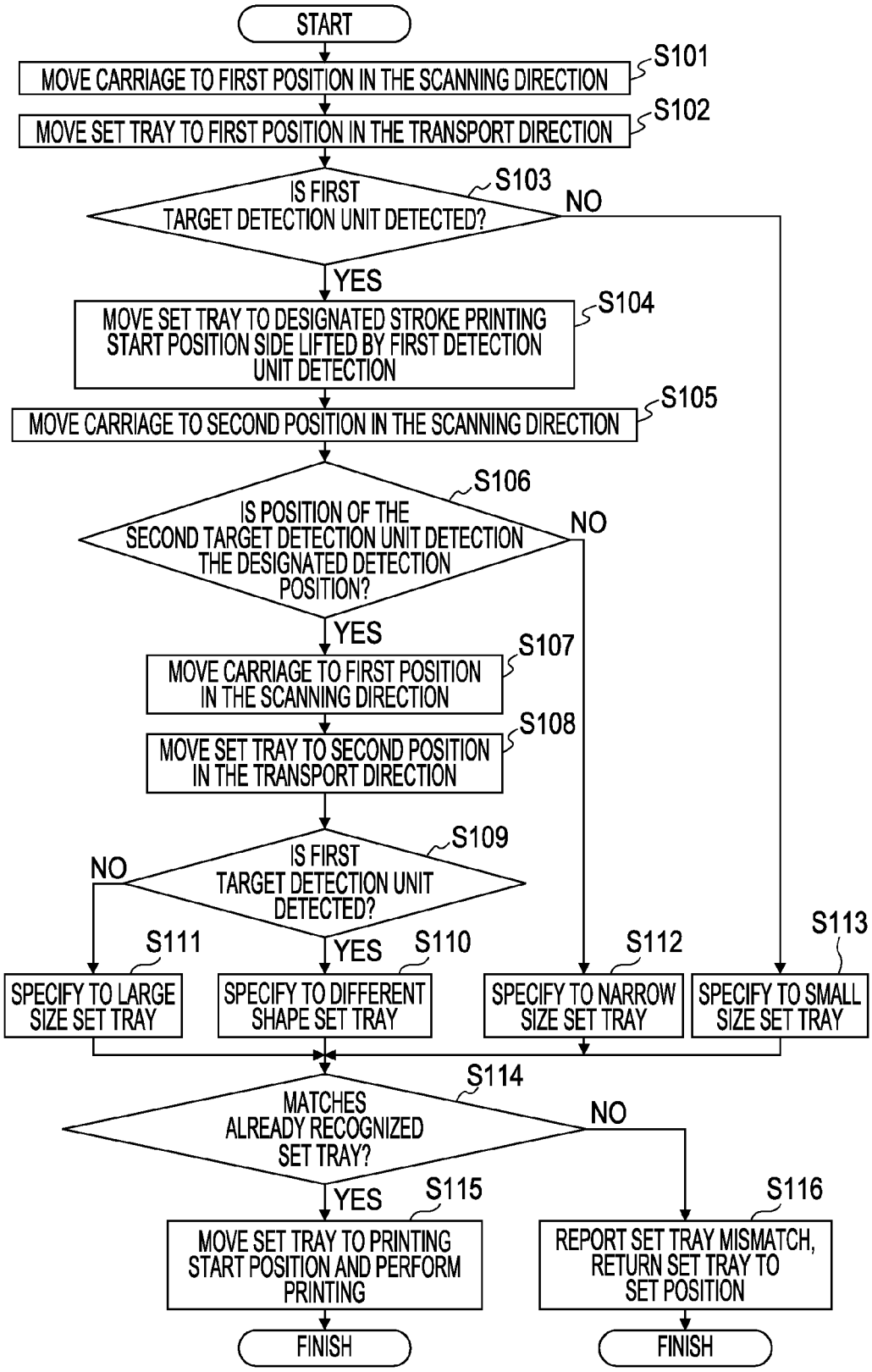
FIG. 11 is a flowchart illustrating an example of the operation flow to detect the type of set tray using the ink jet textile printing apparatus shown in FIG. 8.

Then, the detection and discrimination operations of set tray 3 shown in FIG. 11 are started by receiving the printing execution command. The carriage 21 is moved to the first position Q1 in the scanning direction in step S101 in FIG. 11.

Next, the process moves to step S102 and the movement unit 17 is driven to move the set tray 3 to the first position P1 in the movement direction. Here, at the timing at which the set tray 3 moves to the first position P1, when using the large-sized set tray 3A, when using the set tray 3C with a different shape and when using the narrow set tray 3D, as shown in (i) of FIG. 10A, first target detection units 25 of set trays 3A, 3C and 3D are set so as to be positioned below the detection unit 5.

On the other hand, when using the small-sized set tray 3B, the first target detection unit 25 of set tray 3B is in a state of having not yet reached below the detection unit 5, as shown in (ii) of FIG. 10A. Because the set tray 3B is smaller, the first target detection unit 25 has not yet positioned below the detection unit 5.

Next, returning to FIG. 11 and moving to step S103, a determination is performed to determine whether the detection unit 5, which is positioned in the first position Q1 in the scanning direction, detects the first target detection unit 25. Then, in a case where the detection of the first target detection unit 25 is confirmed, the process moves to step S104, the movement unit 17 is driven and the set tray 3 is moved to the printing start position K side by a predetermined stroke Z released by the detection of first target detection unit 25 (FIG. 10B)

Next, the process moves to step S105 and the carriage 21 is moved to the second position Q2 in the scanning direction by driving the carriage 21. In a case where a large-sized set tray 3A is used, because the second position Q2 in the scanning direction is set to a region outside the home position side in which the detection unit 5 does not pass over the second target detection unit 27, the configuration is always to be able to detect the second target detection unit 27 of set tray 3 partway through movement to the second position Q2 in the scanning direction.

Figure 10A:
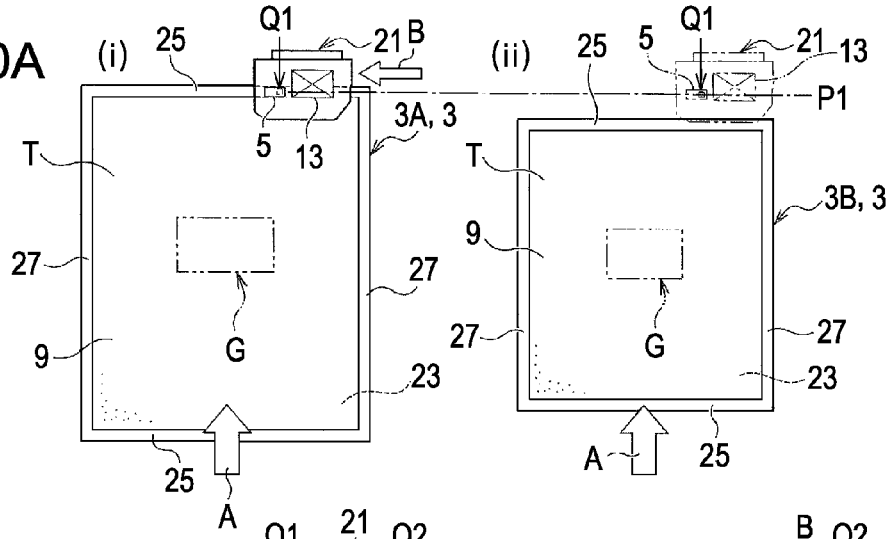
FIGS. 10A to 10C are plan views illustrating an example of a procedure to detect the type of set tray using the ink jet textile printing shown in FIG. 8.
Figure 10B:
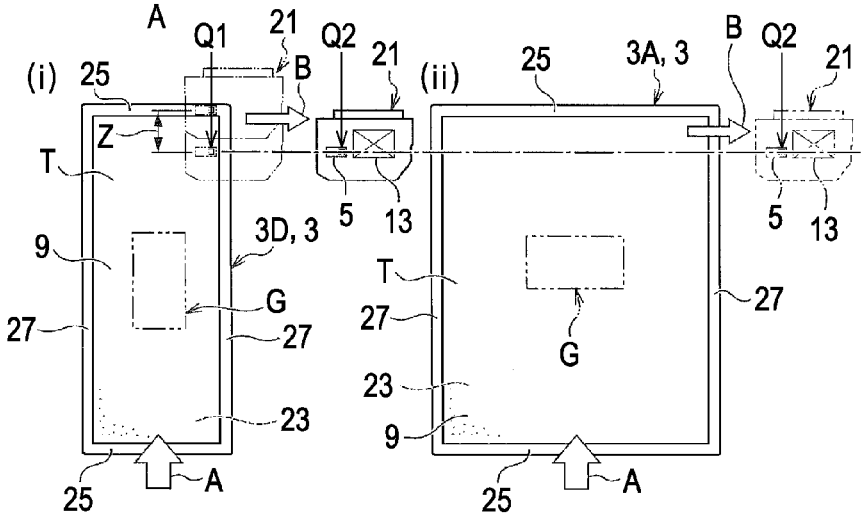

Accordingly, as shown in (i) in FIG. 10B, in a case where the width dimension of set tray 3 is narrow, the second target detection unit 27 is detected at an earlier timing. As shown in (ii) in FIG. 10B, in a case where the width dimension of set tray 3 is wide, the second target detection unit 27 is detected at a later timing or at a later time.

Next, returning to FIG. 11, in step S106 a determination is performed as to whether the detection position of the second target detection unit 27 is a predetermined position. In addition, the detection position of the second target detection unit 27 is set to a predetermined position when using the large-sized set tray 3A.

Then, in a case where it is determined in step S106 that the detection position of the second target detection unit 27 is the predetermined position, the process moves to step S107, and the carriage 21 is driven and the carriage 21 is again moved to the first position Q1 in the scanning direction.

Next, the process moves to step S108, the movement unit 17 is driven, and the set tray 3 is moved to a second position P2 in the movement direction.

Figure 10C:
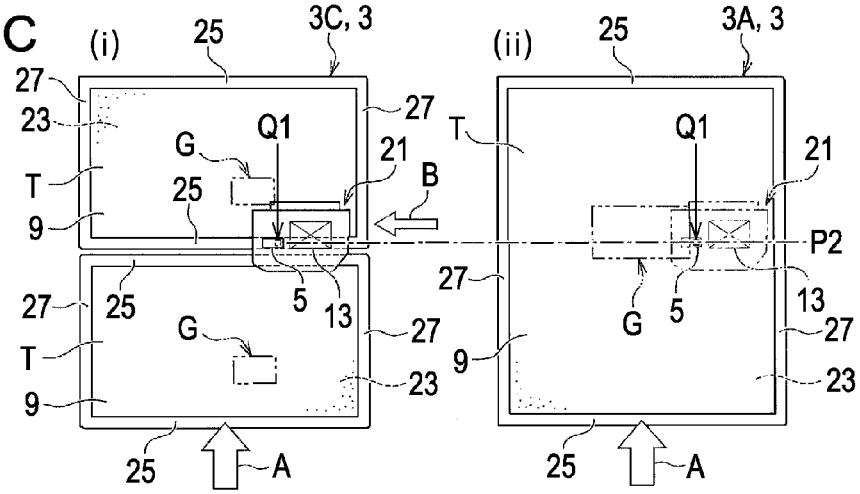

In addition, at the second position P2 in the movement direction, when set tray 3C with a different shape is used, as shown in (i) in FIG. 10C, the first target detection units 25 of the set trays 3C and the gap between front and back set trays 3C is confirmed by the detection unit 5. On the other hand, when the large-sized set tray 3A is used, as shown in (ii) in FIG. 10C, the first target detection unit 25 or the gap are not present, and are not confirmed. This enables a discrimination to be made between the set tray 3A and the set tray 3C.

Next, returning to FIG. 11, a determination whether the first target detection unit 25 is detected in step S109 is performed. In a case where the first target detection unit 25 is detected, the process moves to step S110 and the set tray 3C with a different shape is specified or identified.

Further, in a case where it is determined that the first target detection unit 25 is not detected in step S109, the process moves to step S111, and the large-sized set tray 3A is specified or confirmed.

Further, in a case where it is determined that the detection position of the second target detection unit 27 detected in step S106 is not the predetermined position, the process moves to step S112 and the narrow set tray 3D is specified or identified.

In addition, in a case where it is determined that the first target detection unit 25 has not been detected in step S103, the process moves to step S113 and the small-sized set tray 3B is specified.

Next, the process moves to step S114 and a determination of whether there is a match with the type M of the set tray 3 specified in the newly acquired printing data 35 is performed. In a case where it is determined that there is a match with the type M of the set tray 3 specified in the newly acquired printing data 35 (L=M), the process moves to step S115. In step S115, the movement unit 17 is driven, the set tray 3 is moved to the printing start position K and printing is performed.

On the other hand, in a case where it is determined in step S114 that there is not a match with the type M of the set tray 3 specified in the newly acquired printing data 35 (L≠M), the process moves to step S116. In step S116, notification of a set tray 3 mismatch is performed, the movement unit 17 is driven in the reverse direction, and the set tray 3 is returned to its original set position S.

By using the ink jet textile printing apparatus 1B according in this manner, as a result of exhibiting the same action and effects other examples mentioned above and further increasing the types of set tray 3 that can be detected, application of an ink jet textile printing apparatus 1B that is capable of detecting and determining a greater number of set trays 3 that differ in size, shape and configuration is possible.

Figure 12A:
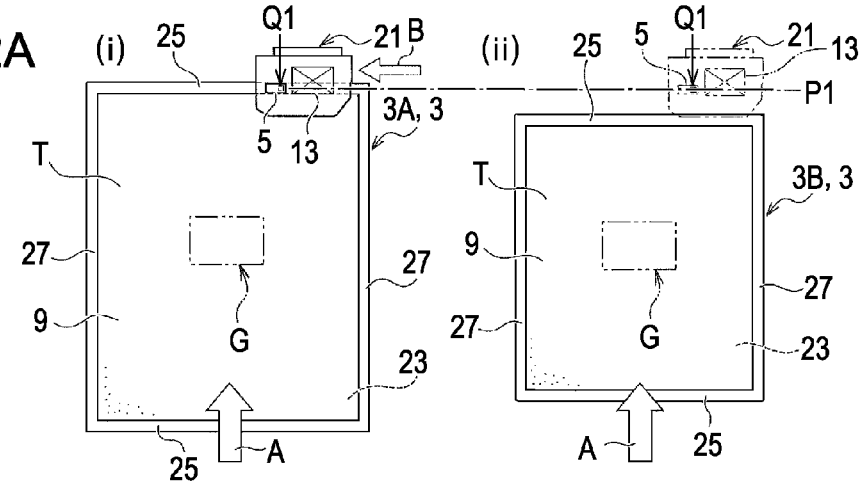
FIGS. 12A to 12C are plan views illustrating another example of the procedure to detect the type of set tray using the ink jet textile printing apparatus shown in FIG. 8.
Figure 12B:
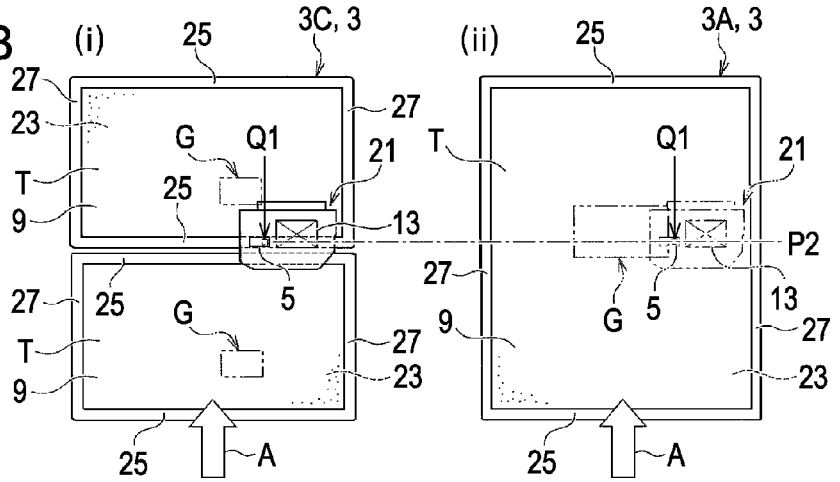
Figure 12C:
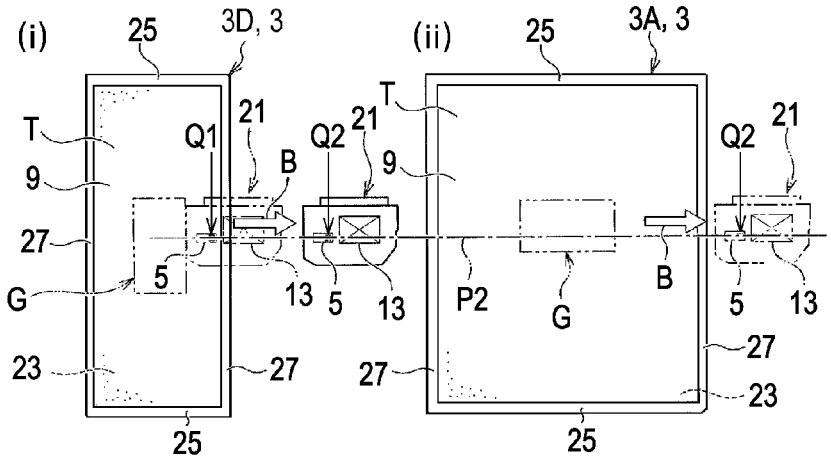
Figure 13:
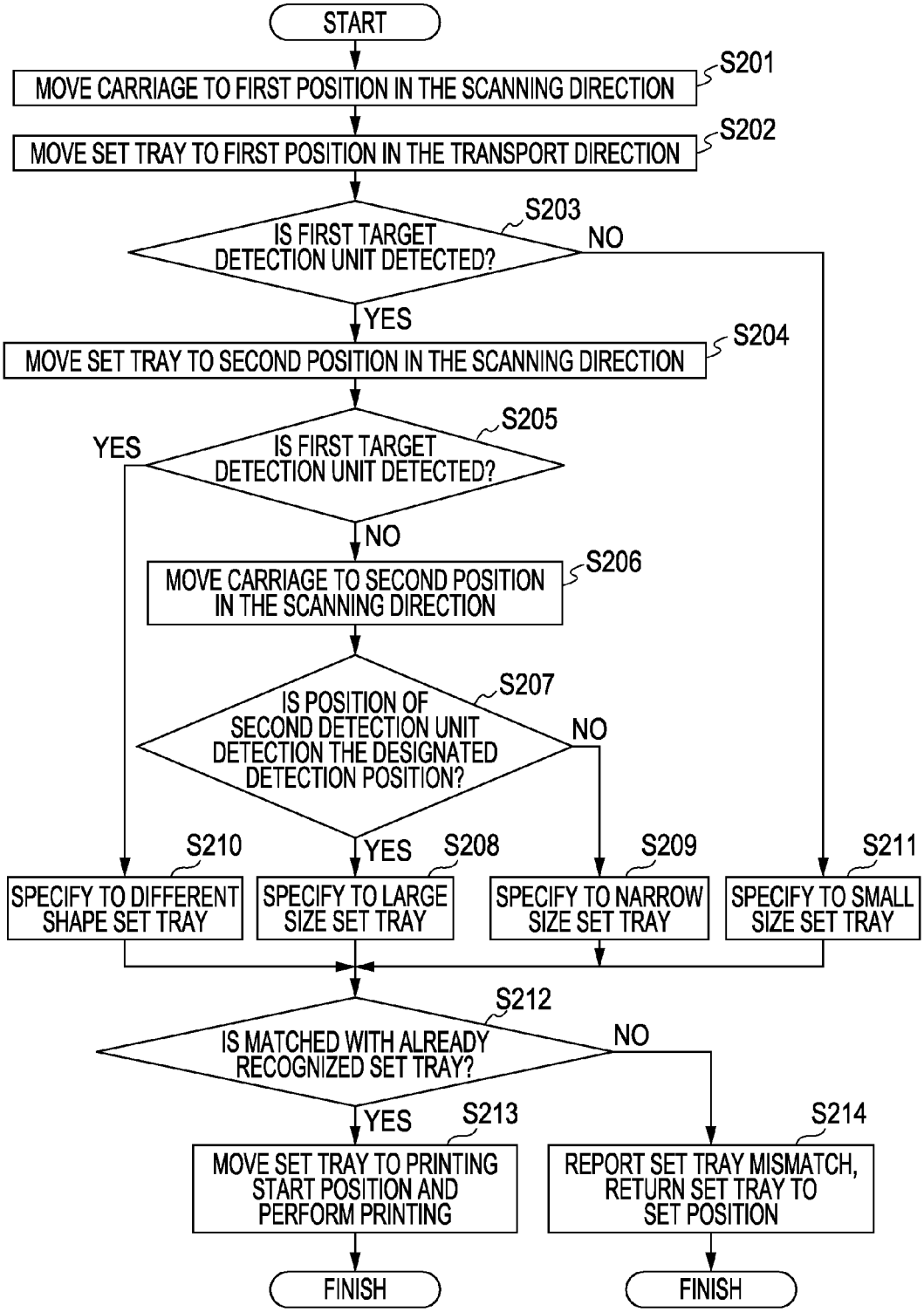
FIG. 13 is a flowchart illustrating another example of the operation flow to detect the type of set tray using the ink jet textile printing apparatus shown in FIG. 8.

Further, in a case of using the ink jet textile printing apparatus 1B, it is possible to adopt a different example that is different from the detection procedures for the types of set tray 3 shown in FIGS. 12A to 12C, and a different example that is different from the operation flow during detection shown in FIG. 13. In other words, it is possible to perform the detection procedures in a different manner and it is possible that the operation flow of the detection procedure can be different.

In other words, in this case, when a printing execution command is received from the user, the set tray 3 detection and determination operation using the flow shown in FIG. 13 starts, and the carriage 21 is moved to the first position Q1 of the scanning direction in step S201 in FIG. 13.

Next, the process moves to step S202, the movement unit 17 is driven and the set tray 3 is moved to the first position P1 in the movement direction. In addition, in the first position P1 in the movement direction, when using the large-sized set tray 3A, the set tray 3C with a different shape and the narrow set tray 3D, as shown in (i) in FIG. 12A, the first target detection unit 25 of set trays 3A, 3C and 3D are set so as to be positioned below the detection unit 5.

On the other hand, when using the small-sized set tray 3B, as shown in (ii) in FIG. 12A, the first target detection unit 25 of the set tray 3B has not yet reached the position below the detection unit 5.

Next, returning to FIG. 13, the process moves to step S203 and determination of whether the detection unit 5 located in the first position Q1 of the scanning direction has detected the first target detection unit 25 is performed. Then, in a case where detection of the first target detection unit 25 has been confirmed, the process moves to step S204. In step S204, the movement unit 17 is driven to move the set tray 3 to the second position P2 in the movement direction. Next, the process moves to step S205 and a determination of whether the detection unit 5 has detected the first target detection unit 25 is performed in step S205.

In a case where it is determined that the first target detection unit 25 was not detected in step S205, the process moves to step S206. In step S206, the carriage 21 is driven and moved to the second position Q2 of the scanning direction.

Incidentally in this embodiment, in a case where the large-sized set tray 3A is used, since the second position Q2 in the scanning direction is set in a region outside the home position side in which the detection unit 5 does not pass over the second target detection unit 27, the second position Q2 of the scanning direction is configured such that it is always possible to detect the second target detection unit 27 of the set tray 3 during movement to the second position Q2 of the scanning direction.

Therefore, as shown in (i) in FIG. 12C, in a case where the width dimension of the set tray 3 is narrow, the second target detection unit 27 is detected at an earlier timing, and as shown in (ii) in FIG. 12C, and in a case where the width dimension of set tray 3 is wide, the second target detection unit 27 is detected at a later timing.

Next, returning to FIG. 13, determination of whether the detection position of the second target detection unit 27 in step S207 is the predetermined position is performed. In addition, the detection position of the second target detection unit 27 is set to a predetermined position when using the large set tray 3A.

Further, in a case where it is determined in step S207 that the detection position of the second target detection unit 27 is the predetermined position, the process moves to step S208 and the large-sized set tray 3A is specified.

Further, in a case where it is determined in step S207 that the detection position of the second target detection unit 27 is not the predetermined position, the process moves to step S209 and the narrow set tray 3D is specified.

Further, in a case where it is determined that the first target detection unit 25 was detected in step S205, the process moves to step S210 and the set tray 3C with a different shape is specified.

In addition, in a case where it is determined that the first target detection unit 25 was not detected in step S203, the process moves to step S211 and the small-sized set tray 3B is specified.

Next, the process moves to step S212 and a determination of whether there is a match with the type M of the set tray 3 specified in the newly acquired printing data 35 is performed. In a case where it is determined that there is a match with the type M of the set tray 3 specified in the newly acquired printing data 35 (L=M), the process moves to step S213. In step S213, the movement unit 17 is driven, the set tray 3 is moved to the printing start position K and printing is performed.

On the other hand, in a case where it is determined in step S212 that there is not a match with the type M of the set tray 3 specified in the newly acquired printing data 35 (L≠M), the process moves to step S214. In step 214, a notification of a set tray 3 mismatch is made, the movement unit 17 is driven in the reverse direction and the set tray 3 is returned to its original set position S.

According to the set tray 3 detection and determination shown in FIGS. 12A to 13, it is also possible to obtain the same action and effects as the set tray 3 detection and determination shown in FIGS. 10A to 11. Further, since a compact operation flow in which steps S104 and S107 in FIG. 11 are not performed is realized, it is possible to achieve a reduction in the amount of time taken by the set tray 3 detection and determination.

The ink jet textile printing apparatus 1 according to the invention has the above-mentioned basic configuration, but naturally it is also possible to make partial configuration alterations and omissions or the like within a scope that does not depart from the spirit of the invention.

For example, in addition to applying the detection unit 5 to a so-called serial type ink discharge head 13 which is mounted in a carriage 21 that is capable of reciprocating in the scanning direction B, it is possible to apply the detection unit 5 to a so-called line type ink discharge head 13 which prints over the entire printing range in the width direction of a target printing material T at once.

Further, in addition to providing the detection unit 5 adjacent to the ink discharge head 13, it is also possible to provide the detection unit 5 in a fixed state separate from the ink discharge head 13 in an appropriate location of the apparatus main body 2 of the ink jet textile printing apparatus 1.

Then, in such cases, since movement of the carriage 21 is unnecessary, it is possible to not perform step S1 in FIG. 7.

In addition, it is also possible to provide a separate power and mechanism to move the detection unit 5 in either one of, or both the length direction and the width direction of the set tray 3, and it is also possible to provide a plurality of detection units 5 and adopt a configuration in which position detection of the first target detection unit 25 and the second target detection unit 27 of the set tray 3 is performed by the plurality of detection units 5.

In addition to this, the type of set tray 3 is not limited to those shown in FIGS. 5A and 5B and FIGS. 9A to 9D mentioned above, and it is possible to adopt various shapes, sizes and configurations of set tray 3 such as a disc-shape, a non-rectangular planar polygon shape, or a shape with two pairs arranged in the width direction.

Further, in the control unit 19, as a mode of informing a user that there is a mismatch of the type of set tray 3, it is possible to use various modes such as an alarm sound, a voice or, turning on or flashing of an LED light, displaying on a display, individually or in combination.

In each embodiment above, in the tray detection operation, a structure in which the ink discharge unit is fixed and the set tray moves was described, but conversely, a structure in which the set tray is fixed and the ink discharge unit moves or a structure in which both move is possible.

Further, in the embodiments above, a structure in which the detection unit is moved in the direction which the second target detection unit passes was described, but a structure in which the detection unit is fixed and the second target detection unit side is moved or a structure in which both move is possible.

What is claimed is:

1. A printing apparatus comprising:

a tray attaching unit that can be attached to a plurality of types of set trays on which a target printing material is set;

an ink discharge unit which prints by discharging ink onto the target printing material according to printing data;

a storage unit which stores a type of set tray specified in the printing data;

a detection unit which detects the type of set tray being attached to the tray attaching unit; and a control unit which controls a tray detection operation of detecting the type of set tray, performed by the detection unit before printing starts;

wherein the control unit compares the type of set tray specified in newly acquired printing data and the type of set tray stored in the storage unit, wherein the tray detection operation is performed when the types are different and wherein the detection operation is omitted when the types are the same.

2. The printing apparatus according to claim 1, wherein the control unit performs the tray detection operation when the newly acquired printing data includes settings related to the type of set tray, and omits the tray detection operation when the newly acquired printing data does not include the settings.

3. The printing apparatus according to claim 1, wherein the control unit omits the tray detection operation after the second of a plurality of target printing materials when newly acquired printing data includes content which performs printing with respect to a plurality of target printing materials using the same type of set tray.

4. The printing apparatus according to claim 1, wherein when the tray detection operation is executed, the control unit performs printing when the type of set tray specified in the newly acquired printing data and the type of set tray detected by the tray detection operation are the same, and does not perform printing when the types are different.

5. The printing apparatus according to claim 1, further comprising:

a movement unit which relatively moves at least one of the ink discharge unit and the set tray between a set position at which the target printing material is set and a target printing material printing start position, wherein the tray detection operation is executed when at least one of the ink discharge unit and the set tray is relatively moved from the set position to the printing start position.

6. The printing apparatus according to claim 5, wherein a speed of the relative movement from the set position to the printing start position is faster when the tray detection operation is omitted than when the tray detection operation is executed.

7. The printing apparatus according to claim 5, wherein the set tray includes a first target detection unit which is positioned at one side or the other side in the movement direction when at least one of the ink discharge unit and the set tray is moved on the outside of a region occupied by the target printing material, in a state where the target printing material is set, wherein detection of the type of set tray by the detection unit is performed based on the detection timing of the first target detection unit when at least one of the set tray ink and the discharge unit is relatively moved from the set position to the printing start position.

8. The printing apparatus according to claim 7, further comprising:

a second target detection unit which is positioned on at least one side in a direction intersecting the movement direction when at least one of the ink discharge unit and the set tray is moved on the outside of the region occupied by the printing material in a state where the target printing material is set in the set tray, wherein detection of the type of set tray by the detection unit is performed based on the detection timing of the first target detection unit when at least one of the ink discharge unit and the set tray is relatively moved from the set position to the printing start position and detection information obtained by relatively moving the detection unit in a direction which passes through the second target detection unit.

9. The printing apparatus according to claim 5, wherein the set tray includes a first target detection unit which is positioned at one side or the other side in a movement direction when at least one of the ink discharge unit and the set tray is relatively moved.

10. The printing apparatus according to claim 9, wherein the set tray includes a second target detection unit which is positioned on at least one side in a direction intersecting the movement direction.

11. The printing apparatus according to claim 1,wherein the detection unit includes an optical sensor.

12. A printing method comprising:

comparing a type of set tray specified in newly acquired printing data and the type of set tray stored in a storage unit;

performing a tray detection operation which detects the type of set tray being attached to a tray attaching unit when the types are different; and omitting the tray detection operation when the types are the same.

* * * * *